United States Patent [19]

Griffith

[11] 4,201,417

[45] May 6, 1980

[54] DEMOUNTABLE SEATING FURNITURE

[76] Inventor: Jeremy N. Griffith, Clothiers Creek Rd., Condong, N.S.W., 2484, Australia

[21] Appl. No.: 970,168

[22] Filed: Dec. 18, 1978

[51] Int. Cl.[2] ..... A47C 7/00

[52] U.S. Cl. ..... 297/442; 297/419; 297/445; 297/455; 297/440

[58] Field of Search ..... 297/419, 440–445, 297/455

[56] References Cited

U.S. PATENT DOCUMENTS

| | | | |
|---|---|---|---|
| 1,695,101 | 12/1928 | Hoffman | 297/444 X |
| 2,608,243 | 8/1952 | Kostrowski | 297/444 X |
| 3,485,527 | 12/1969 | Barghout | 297/442 X |
| 3,680,916 | 8/1972 | Gilbert et al. | 297/440 |
| 3,752,533 | 8/1973 | Gilbert | 297/441 X |
| 4,082,356 | 4/1978 | Johnson | 297/442 |

*Primary Examiner*—James C. Mitchell

*Attorney, Agent, or Firm*—Stevens, Davis, Miller & Mosher

[57] ABSTRACT

A demountable article as seating furniture, such as a chair or setter, which is easily transportable and compactly stackable when demounted and yet is an attractive piece of furniture when set up for use.

3 Claims, 6 Drawing Figures

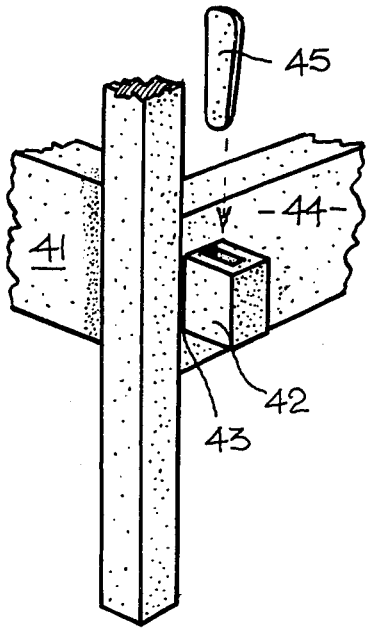
Fig. 5
Fig. 6
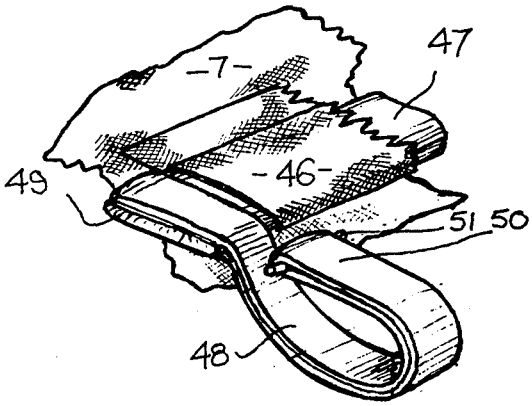

DEMOUNTABLE SEATING FURNITURE

This invention relates to demountable articles of seating furniture, such as chairs and settees, and more particularly to demountable articles of seating furniture which are easily transportable and compactly stackable when demounted and yet are most handsome and attractive pieces of furniture when set up for use.

Many kinds of demountable, collapsible and folding seating furniture known to the present applicant are certainly useful, easily transportable and compactly stowable but are very seldom handsome in appearance when set up for use.

It is therefore an object of this invention to provide demountable articles of seating furniture which, while being readily and easily transportable and compactly stowable when 'knocked down, ' are nevertheless handsome in appearance when set up for use and which may be fabricated from fine and rare timbers, leathers and upholstery fabrics.

It is also an object of the present invention to provide such articles of furniture which require no nails, screws, brackets, corner-pieces or other metal hardware in their construction.

In order that the reader of this specification may gain a better understanding of the present invention, hereinafter will be described a preferred embodiment thereof, by way of example only and with reference to the accompanying drawings in which:

FIG. 5 is a fragmentary perspective view of a typical corner of the chair; and FIG. 6 is a fragmentary perspective view from below showing one of the suspending straps.

In the drawings, integers in common in FIGS. 1 to 4 are referenced with the same numerals.

Figure 1:
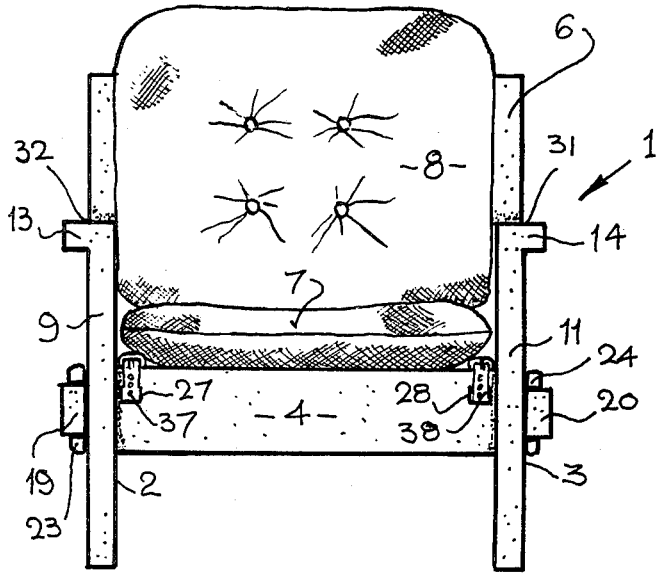
FIG. 1 is a front elevation of a chair constructed in accordance with the present invention.
Figure 2:
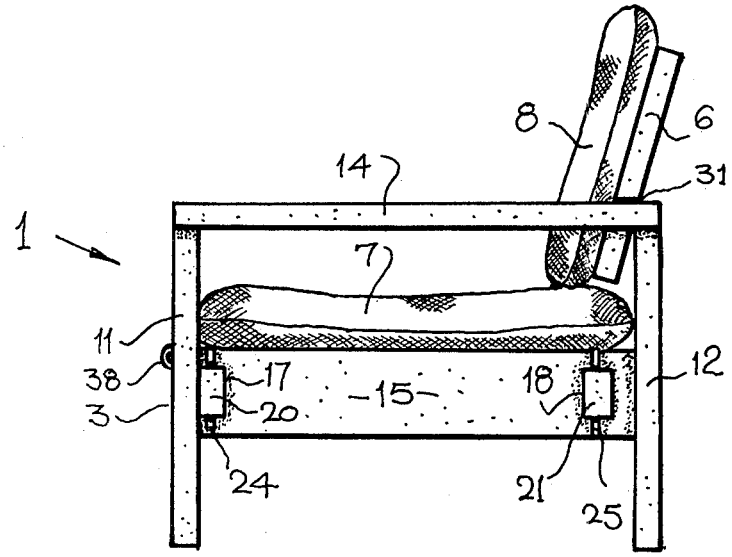
FIG. 2 is a side elevation thereof.
Figure 3:
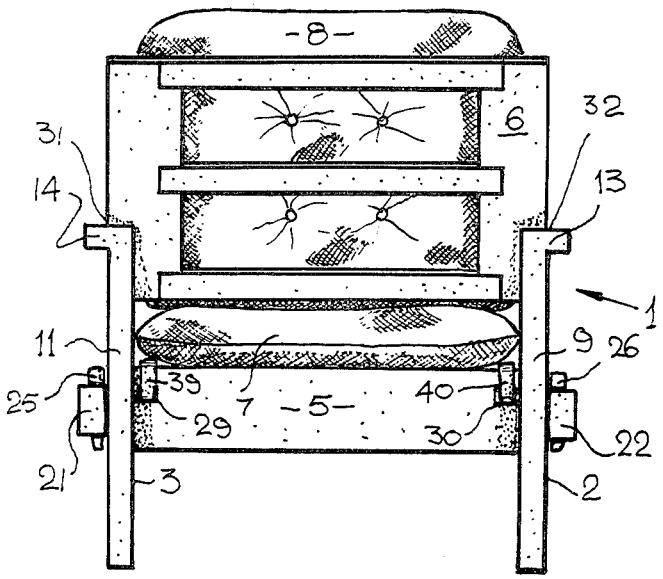
FIG. 3 is a rear elevation thereof.

In FIGS. 1 to 4 there is shown a chair according to the present invention, from different viewpoints. The chair, generally referenced 1, comprises a pair of wooden side frames 2,3; a wooden front beam 4; a wooden rear beam 5; a wooden backrest 6; a seat cushion 7 and a backrest cushion 8.

The wooden side frames 2,3 are mirror images of each other and each has two legs, collectively referenced 9,10,11,12, an armrest 13,14 connecting the upper ends of the respective legs and a side member 15 (see FIG. 2),16 which is identical with side member 15 but which is an integer of side frame 2 as will be appreciated from a perusal of the drawings. These side members, as exemplified by side member 15, each have through them a pair of apertures such as 17,18 (FIG. 2) located adjacent the legs of the side frames.

Wooden front beam 4 has, at each end, a portion of reduced dimensions 21,22 which extends through associated apertures in side members 15,16 as shown, said portions being removably secured therein by wooden pegs 23,24,25,26. This arrangement is shown in greater detail in FIG. 5, shortly to be described herein.

Front beam 4 is provided with apertures 27 and 28 adjacent its top edge and rear beam 5 with similar apertures 29,30; the purpose of these apertures is to be later described herein.

Wooden backrest 6 has, cut into its outer edges, recesses 31,32, at oblique angles to receive, respectively, the armrests 14,13, of the wooden side frames.

Figure 4:
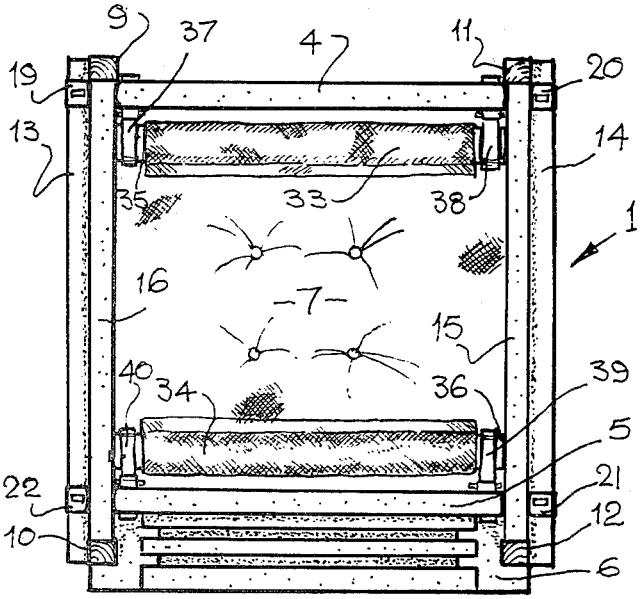
FIG. 4 is a plan view from underneath the chair.

The seat cushion 7 is provided, on its lower surface, with a pair of sleeves 33,34 which are firmly affixed to the said lower surface of seat cushion 7, as by stitching (see FIG. 4). Rigid slats, preferably of wood, 35,36, extend through sleeves 33,34 respectively, these slats being removably attached to both the front and rear beams 4,5 by means of straps 37,38,39,40; these fastenings will be more fully described with reference to FIG. 6.

Backrest cushion 8 rests upon seat cushion 7 and against wooden backrest 6 when the chair is set up for use.

Turning now to FIG. 5, there is shown a typical corner of a chair according to the present invention. A beam 41, either of the above-described front or rear beams, has a portion 42 of reduced dimensions which extends through aperture 43 in a side member 44 of either wooden side frame. Beam 41 is secured with respect to side member 44 by means of a shaped wooden peg 45 which is adapted to wedge firmly into aperture 43.

FIG. 6 shows in more detail from below and with the frame members absent, for greater clarity, the fastening arrangements with respect to straps, referenced 37,38,39 and 40 above and previously briefly described. The lower surface of seat cushion 7 is provided with a pair of sleeves, a fragment of one of which, now referenced 46, is shown in FIG. 6. A slat 47 extends through sleeve 46. A strap 48, ideally of saddle leather, in the form of a loop, has one end of this loop passed around an end 49 of slat 47. The other looped end 50 of strap 48 is passed over a front or rear beam of the chair frame and is then pushed through an aperture provided in the said beam and secured by means of a dowel 51 which effectively prevents end 50 of strap 48 from slipping out of the associated aperture.

While the present invention has been described in relation to an armchair, a similar settee is also contemplated. In such a construction, the backrest and the front and rear beams will, of course, be longer but the side frames will be exactly as for the chair embodiment. To give the required added support to the seat cushion, each settee slat may have, say, four straps extending outwardly through suitable holes in the sleeves; these straps will pass through four co-operating apertures in each beam.

For increased 'eye-appeal, ' the outer edges of the armrests and the top edge of the backrest may be the natural edges of planks sawn from a tree trunk and thus may have the bark still upon them.

The claims defining the invention are as follows, I claim:

1. A demountable article of seating furniture comprising a pair of wooden side frames, a wooden front beam, a wooden rear beam, a wooden backrest, a seat cushion and a backrest cushion; each said wooden side frame having two legs, an armrest connecting the upper ends of said legs and a side member between said legs and connected thereto at a position intermediate between said armrest and the lower ends of said legs, said side member having therethrough a pair of apertures located one adjacent each said leg; each of said wooden front and rear beams having at each end thereof a portion of reduced dimensions adapted to extend through a co-operating one of said side member apertures and to be secured therein by means of a wooden peg which extends through a vertically-oriented aperture in said reduced portion, and each said front and rear beams having therethrough at least two horizontally-oriented apertures adjacent the top edge thereof; said wooden backrest having a recess in each outer edge thereof, into which slot is receivable a said side frame armrest; said seat cushion having, on the lower surface thereof, a pair of sleeves, one sleeve adjacent the rear edge of said seat cushion and the other adjacent the front edge of said seat cushion, each said sleeve having a rigid slat extending therethrough, said rear slat being removably attachable to said rear beam and said front slat being removably attachable to said front beam by straps each of which extends through a said horizontally-oriented aperture and around an end of a said slat; said backrest cushion resting on said seat cushion and against said wooden backrest.

2. The demountable article of seating furniture as claimed in claim 1, wherein each said strap is in the form of a loop, one end of said loop passing about a said slat end and the other end passing over the upper edge of a said beam and extending through a said horizontally-oriented aperture therein in an inward direction, the said other end being secured from slipping out of said aperture by means of a dowel which extends through said looped other end.

3. The demountable article of seating furniture as claimed in claim 1 or claim 2, wherein said recesses in the outer edges of the said backrest are made oblique thereto to enable said backrest to assume a backwardly sloping position.

* * * * *